US006373351B1

(12) United States Patent
Kubota et al.

(10) Patent No.: US 6,373,351 B1
(45) Date of Patent: Apr. 16, 2002

(54) TM010 MODE BAND ELIMINATION DIELECTRIC FILTER, DIELECTRIC DUPLEXER AND COMMUNICATION DEVICE USING THE SAME

(75) Inventors: Kazuhiko Kubota, Mukou; Tomoyuki Ise, Nagaokakyo, both of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/225,162

(22) Filed: Jan. 4, 1999

(30) Foreign Application Priority Data

Jan. 5, 1998 (JP) ..... 10-000306
Feb. 25, 1998 (JP) ..... 10-043784

(51) Int. Cl.[7] ..... H01P 1/20; H01P 1/213; H01P 7/10

(52) U.S. Cl. ..... 333/134; 333/202; 333/219.1

(58) Field of Search ..... 333/134, 202, 333/219, 219.1

(56) References Cited

U.S. PATENT DOCUMENTS

| | | | | |
|---|---|---|---|---|
| 2,890,422 A | * | 6/1959 | Schlicke | 333/219 X |
| 4,639,699 A | * | 1/1987 | Nishikawa et al. | 333/219.1 X |
| 4,727,342 A | | 2/1988 | Ishikawa et al. | 333/219 |
| 4,812,791 A | * | 3/1989 | Makimoto et al. | 333/219 |
| 4,996,506 A | | 2/1991 | Ishikawa et al. | 333/219.1 |
| 5,008,640 A | * | 4/1991 | Accatino et al. | 333/219.1 |
| 5,081,435 A | | 1/1992 | Yorita | 333/206 |
| 5,373,270 A | | 12/1994 | Blair et al. | 333/202 |
| 5,446,729 A | * | 8/1995 | Jachowski | 333/134 X |
| 5,719,539 A | | 2/1998 | Ishizaki et al. | 333/204 |
| 5,920,243 A | * | 7/1999 | Ishikawa et al. | 333/219 X |
| 5,920,244 A | * | 7/1999 | Kobayashi et al. | 333/219 |
| 6,016,091 A | * | 1/2000 | Hidaka et al. | 333/219.1 X |
| 6,052,041 A | * | 4/2000 | Ishikawa et al. | 333/219.1 X |

FOREIGN PATENT DOCUMENTS

| | | |
|---|---|---|
| EP | 0496512 | 7/1992 |
| JP | 6-291504 | * 10/1994 |
| JP | 8293705 | 11/1996 |
| JP | 9-116314 | * 5/1997 |
| JP | 10-98316 | * 4/1998 |
| JP | 10-294602 | * 11/1998 |

OTHER PUBLICATIONS

Patent Abstracts of Japan, vol. 97, No. 3, Mar. 31, 1997 & JP 08 293705 A (Murata Mfg. Co. Ltd.), Nov. 5, 1996, abstract.

Ishikawa Y. Et Al.: "Low Profile Filter Using Open Disk Dual Mode Dielectric Resonators for Microcellular Base Station" Proceedings of the 25th European Microwave Conference 1995, Bologna, Sep. 4–7, 1995, vol. 1, No. Conf. 25, Sep. 4, 1995, pp. 528–532, European Microwave Conference Committee, p. 528, right–hand column, line 10–line 22; figures 1, 11.

European Search Report dated Apr. 13, 1999.

* cited by examiner

*Primary Examiner*—Benny Lee
*Assistant Examiner*—Barbara Summons
(74) *Attorney, Agent, or Firm*—Ostrolenk, Faber, Gerb & Soffen, LLP

(57) ABSTRACT

A band elimination dielectric filter in which the non loaded Q is increased by substantially eliminating the actual current flowing in a shield cavity, and the height is reduced. The band elimination dielectric filter includes a conductive shield cavity 11, a dielectric resonator 12 which is arranged in the shield cavity 11 and in which electrodes 18 are formed on two surfaces opposite to each other; and an external coupling 13 which is arranged in the shield cavity and connected to the dielectric resonator 12.

6 Claims, 9 Drawing Sheets

TM010 MODE BAND ELIMINATION DIELECTRIC FILTER, DIELECTRIC DUPLEXER AND COMMUNICATION DEVICE USING THE SAME

BACKGROUND OF THE INVENTION

1. Field of the Invention

The present invention relates to a band elimination dielectric filter, a dielectric duplexer, and a communication device for use in a mobile communication system for example.

2. Description of the Related Art

A conventional band elimination dielectric filter is described referring to FIG. 8 and FIG. 9.

FIG. 8 is a perspective view of a conventional band elimination dielectric filter 110, and FIG. 9 is a bottom plan view. The band elimination dielectric filter 110 comprises a dielectric resonator 120 consisting of ceramic in which two dielectric columns 122 are arranged in an intersecting manner in a cavity 121 having a conductive layer, a metallic case 130 and a base plate 140. A shield cavity comprises the metallic case 130 and the conductive cavity 121.

The metallic case 130 comprises an upper case and a lower case, but the upper case is not indicated in the figure to illustrate the inner structure in FIG. 8. An external connector 131 is for inputting/outputting the signal to/from the outside is mounted on the lower case 130. The base plate 140 is formed by providing a copper film 141 on each surface of an insulated base plate, and a strip line 142 is formed by etching a part thereof. The strip line 142 functions as a $\lambda/4$ wavelength line, and each end thereof is connected to an internal conductor 132 of the external connector 131. In the base plate 140, the strip line 142 is arranged opposite to the lower case 130 on the upper surface side of the lower case 130 so that the strip line 142 is not brought into direct contact with the lower case 130.

One end of a loop 133 for external coupling as an external coupling means is connected to the strip line 142. The loop 133 for external coupling is extended from the base plate 140 upwardly and approximately in the perpendicular direction, while the other end of loop 133 for external coupling is connected to an etching part 143 below the base plate 140 and a copper film 141 (earth part) other than the strip line 142. Above the base plate 140, the copper film 141 in the vicinity of a penetration part of the loop 133 for external coupling is removed, and an earth plate 134 having a hole of approximately same size as that of the removed part is arranged on the base plate 140. The earth plate 134 is mounted on an inner side surface of the lower case 130, and electrically connected thereto.

In such a band elimination dielectric filter 110, the signal inputted from one external connector 131 flows in two loops 133 for external coupling and the strip line 142. The loops 133 for external coupling generate the magnetic field respectively, and the corresponding loop 133 for external coupling is respectively magnetically coupled with the dielectric column 122. Then, the signal except the frequency corresponding to the dielectric column 122 is outputted from the external connector on the output side. The band elimination dielectric filter 110 thus functions as the two-stage band elimination dielectric filter to stop the resonance frequency band specified by the size of the dielectric column 122.

The resonance frequency and the non loaded Q of the dielectric resonator are determined by the size of the cavity and the dielectric column. When the distance in the transverse direction viewed from an opening side of the dielectric resonator is defined as the "width", the distance in the distal direction is defined as the "thickness", and the distance between the contact surfaces of the cavity and the dielectric column is defined as the "height", the following relationship is obtained.

For example, when the size of the cavity is left unchanged, and the width or the thickness of the dielectric column is increased, the resonance frequency is reduced. When the size of the dielectric column is left unchanged and the width of the cavity is increased, the resonance frequency is reduced. As for the relationship between the dielectric resonator and the non loaded Q. the non loaded Q is increased as the height of the dielectric column is increased.

As the height of the dielectric column is increased, the non loaded Q of the dielectric resonator is increased, but the cavity is also increased as the height of the dielectric column is increased. Thus, the conductive layer on the surface of the cavity is also increased in size, and the loss of the actual current flowing in the conductive layer is also increased. The loss corresponding thereto partly cancels the increase in the non loaded Q obtained by increasing the height of the dielectric column. Thus, in order to obtain the required non loaded Q, there is a concern that the dielectric resonator is increased in size. From this reason, a band elimination dielectric filter free from any loss by the actual current flowing in the conductive layer on the surface of the cavity has been desired.

In a case of a two-stage band elimination dielectric filter using a TM double mode dielectric resonator in which two dielectric columns are arranged in an intersecting manner in the cavity, two dielectric columns of the same shape are formed according to the desired resonance frequency. When the non loaded Q of the dielectric resonator is increased, the height of the dielectric column is required to be large, and the cavity is also high accordingly. Increase in the cavity by increasing the height of one dielectric column means increase in the width of the cavity when viewed from the other dielectric column. As described above, when the width of the cavity is increased, the resonance frequency is reduced, and in order to obtain the prescribed resonance frequency, the width or the thickness of the dielectric column is reduced and the resonance frequency is required to be increased. There has been a concern that the resonance frequency and the non loaded Q can not be individually designed even in the two-stage band elimination dielectric filter.

SUMMARY OF THE INVENTION

The band elimination dielectric filter of the present invention is realized in view of the above-mentioned problems, and its object is to provide a band elimination dielectric filter, a band elimination dielectric duplexer and a communication device in which the loss to be generated by the actual current flowing in the conductive layer of the cavity is eliminated, the non loaded Q is high, and the height is reduced. Another object is to provide the band elimination dielectric filter, the dielectric duplexer and the communication device in which the subordination of the resonance frequency and the non loaded Q to each other is weakened, and the resonance frequency and the non loaded Q can be individually designed.

To achieve the above-mentioned objects, the band elimination dielectric filter of the present invention includes a conductive shield cavity, a dielectric resonator which is arranged in the shield cavity and provided with electrodes formed on two surfaces opposite to each other, and an external coupling means which is arranged in the shield cavity and connected to the dielectric resonator.

The actual current flowing in the conductive layer on the surface of the cavity of the dielectric resonator is eliminated by the conventional band elimination dielectric filter, and the loss at the band elimination dielectric filter is eliminated. The corresponding non loaded Q is not canceled, the dielectric resonator need not be so high, and the height of the dielectric resonator can be reduced.

In a band elimination dielectric filter according to a second aspect of the invention, the dielectric resonator is continuously arranged in the shield cavity.

The height can be further reduced thereby.

In a band elimination dielectric filter according to a third aspect of the invention, the dielectric resonators are put on top of each other in the shield cavity.

Because the actual current flowing in the conductive layer on the surface of the cavity of the dielectric resonator is eliminated and the height is reduced compared with the conventional band elimination dielectric filter, the band elimination dielectric filter can be reduced in area.

In a band elimination dielectric filter according to a fourth aspect of the invention, at least one of electrodes formed on two surfaces opposite to each other of the dielectric resonator is formed by a thin film multilayer electrode.

The non loaded Q is further improved thereby.

A dielectric duplexer according to a fifth aspect of the invention includes at least two dielectric filters, a means for input/output connection to be connected to the respective dielectric filters, and a means for antenna connection to be commonly connected to the dielectric filter, and at least one of the dielectric filters is the band elimination dielectric filter according to first through fourth aspects of the invention.

A dielectric duplexer whose height is reduced, and whose loss is small can be provided thereby.

A communication device according to a sixth aspect of the invention includes a dielectric duplexer according to a fifth aspects of the invention, a circuit for transmission to be connected to at least one means for input/output connection of the dielectric duplexer, a circuit for reception to be connected to at least one means for input/output connection different from the means for input/output connection to be connected to the circuit for transmission, and an antenna to be connected to a means for antenna connection of the dielectric duplexer.

A communication device whose height is reduced and whose loss is small can be provided thereby.

DESCRIPTION OF THE PREFERRED EMBODIMENT

Figure 1:
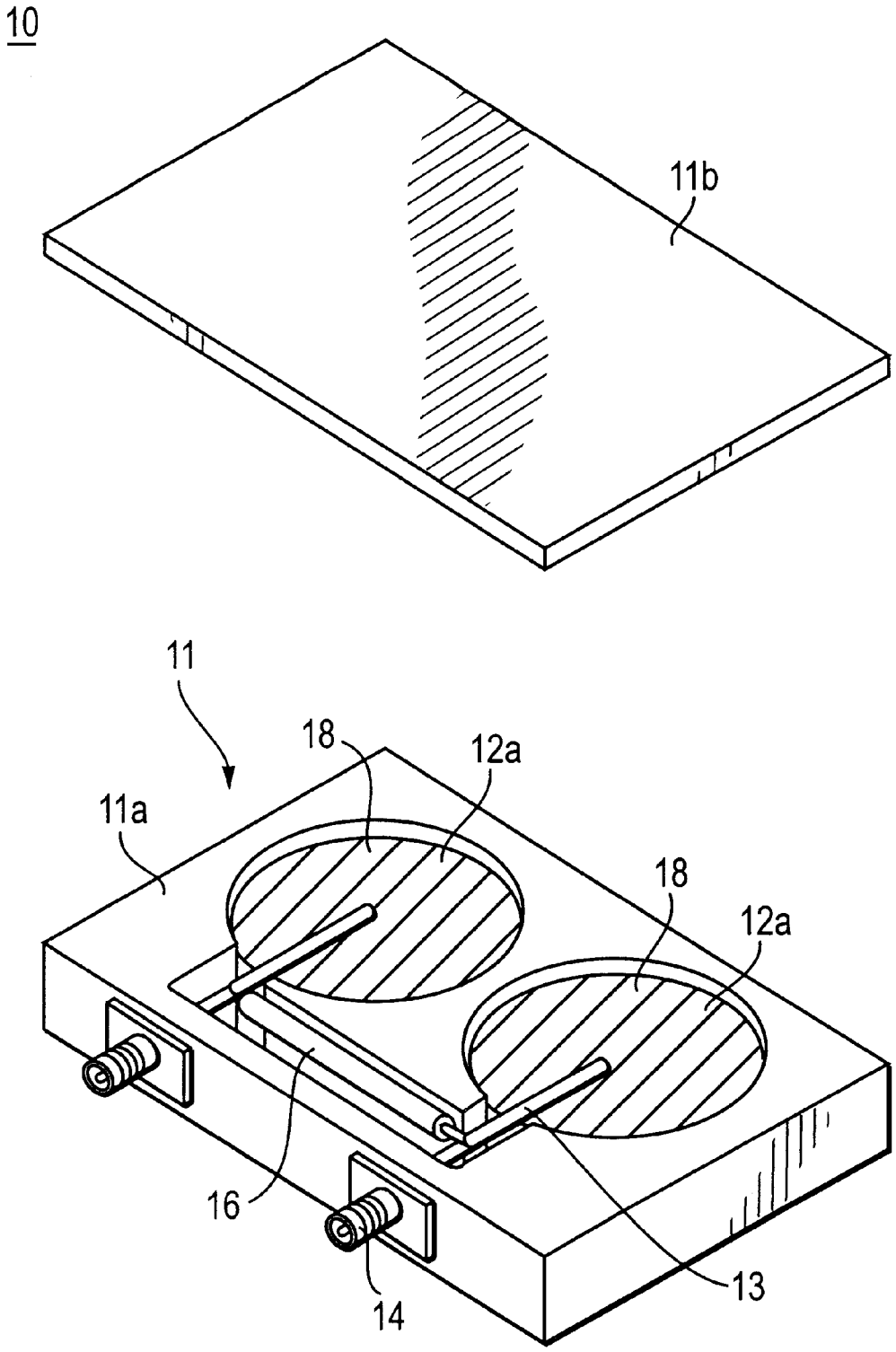
FIG. 1 is an exploded perspective view of a band elimination dielectric filter of the present invention.

An embodiment of a band elimination dielectric filter of the present invention is described referring to FIG. 1. FIG. 1 is an exploded perspective view where a lid part 11*b* of a shield cavity 11 of a band elimination dielectric filter 10 is opened to illustrate the internal condition.

The band elimination dielectric filter 10 comprises the shield cavity 11 formed of a metal such as iron, a dielectric resonator 12*a* having electrodes 18 on two surfaces opposite to each other, an external coupling means 13, and an external connector 14 for input/output to be mounted on the shield cavity 11. That is, in the present embodiment, the two-stage band elimination dielectric filter 10 is constructed so that two dielectric resonators 12*a* are continuously arranged in the body 11*a* of the shield cavity 11 and the external connector 14 for input/output is conducted through a $\lambda/4$ wavelength line 16.

The dielectric-resonator 12*a* is formed of the ceramic in a columnar shape, and electrodes 18 are formed on two surfaces opposite to each other through coating or baking of the silver paste. One electrode surface of the dielectric resonator 12*a* is connected and fixed to an inner bottom surface of the body 11*a* of the shield cavity 11 by a means such as soldering. The reliability on the temperature change is improved if the electrode surface is soldered to a metallic earth plate of the alloy of iron and nickel, and then, stored in the shield cavity 11, and the coefficient of linear expansion of the earth plate is similar to that of the dielectric resonator 12*a* though the arrangement is not indicated in the figure. In this embodiment, the dielectric resonator 12*a* is columnar in shape, but the effect on the characteristic such as the increase in the non loaded Q can be demonstrated compared with the conventional band elimination dielectric filter though the shape is prismatic or any other shape. However, the distance from the center to the edge is not constant on two surfaces opposite to each other on which the electrodes are formed in the prismatic dielectric resonator. Thus, the electric potential difference is generated at the edge of the electrodes, and the current flows therein. Because the current flows and the loss is generated thereby, the columnar dielectric resonator is desirable from the characteristic aspect of the band elimination dielectric filter.

The external coupling means 13 is formed of a metallic wire, and connected to a center conductor of the external connector 14 at one end with the solder. The external coupling means 13 is arranged so as to be extended in the space between the dielectric resonator 12*a* and the shield cavity 11, and the upper electrode 18 of the dielectric resonator 12*a* is separated from the shield cavity 11 with an interval therebetween, and is not electrically connected thereto.

The signal inputted from the external connector 14 flows from the external connector 14 to the external coupling means 13 to generate the capacitance between the external coupling means 13 and the dielectric resonator 12*a*. The external coupling means 13 is connected to the dielectric resonator 12*a* with the capacitance, and resonance is achieved at the resonance frequency to be specified by the area at the section parallel to the electrodes 18 of the dielectric resonator 12*a*. The degree of coupling of the external coupling means 13 with the dielectric resonator 12*a* is determined by the area opposite to each other or the distance therebetween, and the degree of coupling becomes stronger as the area is larger, or as the distance is shorter. Thus, the degree of coupling can be regulated by changing the length of the external coupling means 13 and the place of arrangement. The dielectric filter to stop the wide band can be realized by increasing the degree of coupling, and the dielectric filter to stop the narrow band can be realized by decreasing the degree of coupling. Direct connection of the external coupling means 13 to the dielectric resonator 12*a* maximizes the coupling to obtain the dielectric filter to stop the wide band.

Then, the function of the dielectric filter 10 of the present embodiment is described. The signal to be inputted from the external connector 14 generates the electric field between the electrodes 18 formed on two surfaces opposite to each other of the dielectric resonator 12*a* through the coupling of the external coupling means 13 with the dielectric resonator 12*a*. The magnetic field is generated along the circumference of the dielectric resonator 12*a*, and as a result of the concentrated electromagnetic field within the dielectric resonator 12*a*, the distribution of the electromagnetic field becomes similar to that in the $TM_{010}$ mode.

In such a construction, the actual current hardly flows in the shield cavity 11 in the band elimination dielectric filter 10 of the present invention. Thus, the loss generated by the flow of the actual current in the conductive layer (equivalent to the shield cavity) on the surface of the cavity of the dielectric resonator in the conventional band elimination dielectric filter can be eliminated. Similar to the fact that the non loaded Q of the conventional dielectric resonator has been specified by the height of the dielectric column, the non loaded Q in the present invention is also specified by the height of the dielectric resonator 12*a*. Because the loss is reduced in the present invention as described above, the height of the dielectric resonator 12*a* need not be so large, and the height of the band elimination dielectric filter 10 can be reduced compared with the conventional structure.

The resonance frequency is specified by the area of the dielectric resonator 12*a* at the section parallel to the electrodes 18, and the non loaded Q is mainly specified by the height of the dielectric resonator 12*a*, respectively, and the relationship to affect on each other is practically eliminated. Because the resonance frequency and the non loaded Q can be individually designed according to the desired values, the degree of freedom of the design is increased to facilitate the manufacture of the band elimination dielectric filter 10.

Figure 2:
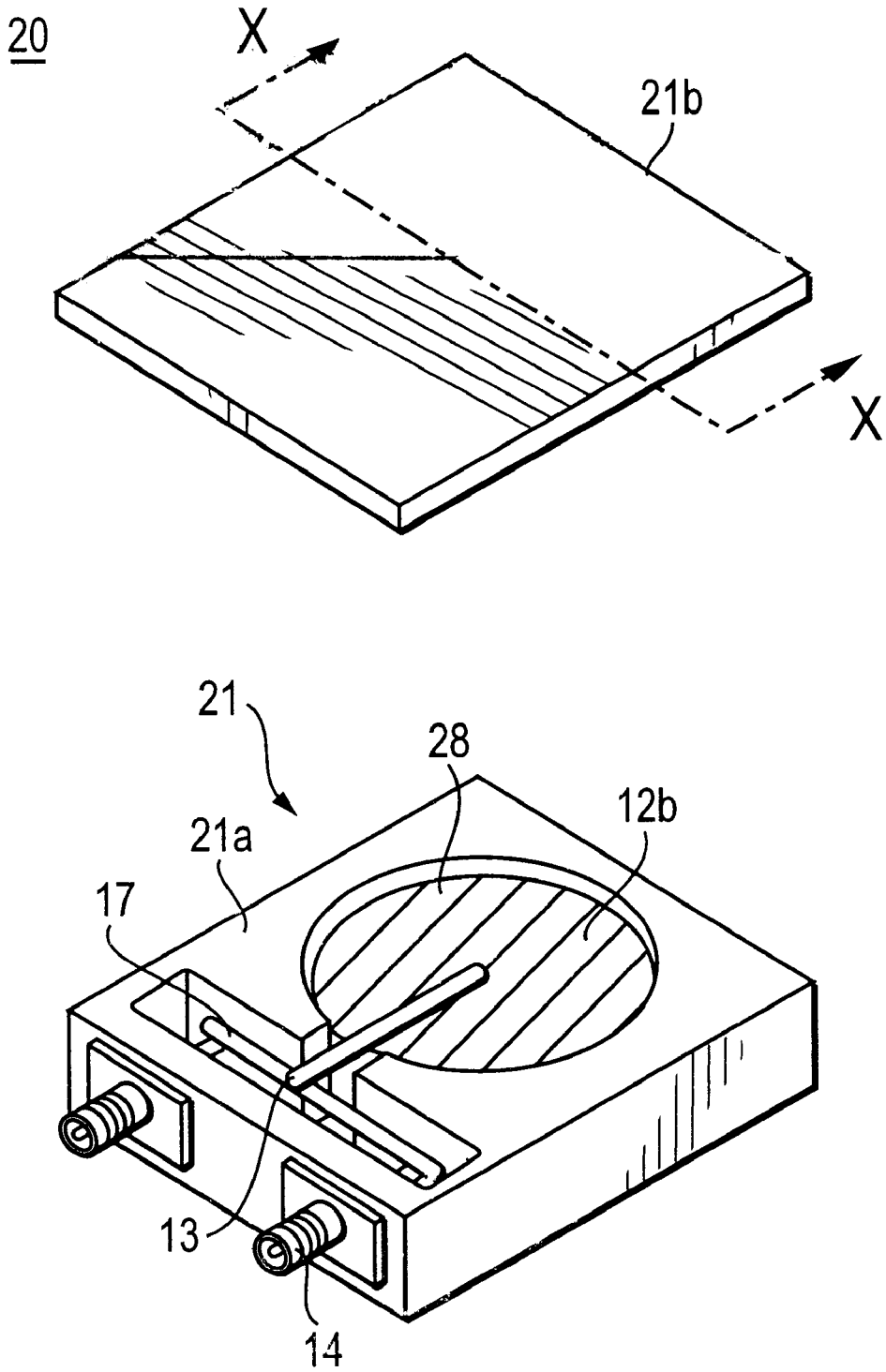
FIG. 2 is an exploded perspective view of a band elimination dielectric filter in a second embodiment of the present invention.
Figure 3:
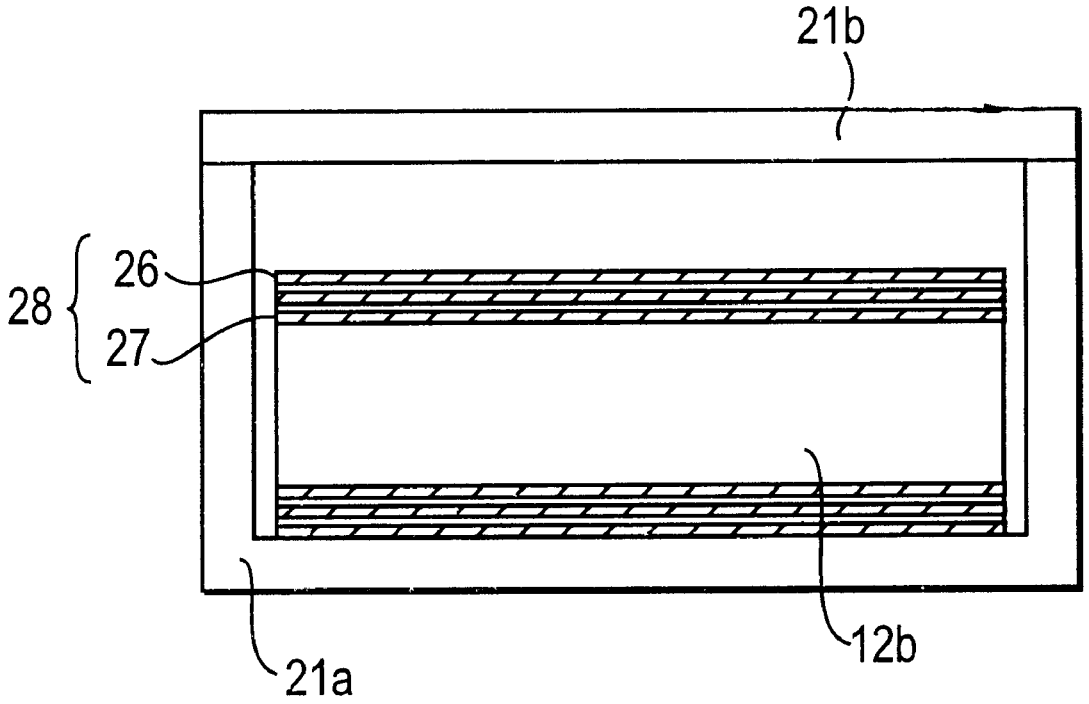
FIG. 3 is a sectional view taken along the line X—X of FIG. 2.

The second embodiment of the present invention is described referring to FIG. 2 and FIG. 3. FIG. 2 is an exploded perspective view where a lid part 21*b* of a shield cavity 21 of a band elimination dielectric filter 20 is opened to illustrate the internal condition similar to FIG. 1 to illustrate the first embodiment. In addition, FIG. 3 is a sectional view taken along the line X—X in FIG. 2. The same symbol is attached to the same part in the first embodiment, and the detailed description is omitted.

The band elimination dielectric filter 20 illustrated in FIG. 2 comprises a metallic shield cavity 21, a columnar dielectric resonator 12*b* in which a thin film multilayer electrode 28 is formed on two surfaces opposite to each other, and an external coupling means 13. External connectors 14 for input/output are mounted on a shield cavity 21, and the external connectors 14 are conducted to each other through a metallic wire 17.

The signal to be inputted from the external connector 14 flows from the metallic wire 17 connected to the center conductor of the external connector 14 with the solder to the external coupling means 13. The external coupling means 13 arranged so as to be extended in the space between the shield cavity 21 and the disconnected electrode side of the dielectric resonator 12*b* soldered to an inner bottom surface of a body 21*a* of the shield cavity 21, is coupled with the dielectric resonator 12*b* with the capacitance. The external coupling means is resonated at the resonance frequency specified by the area of the dielectric resonator 12*b* at the section parallel to the thin film multilayer electrode 28, and functions as the band elimination dielectric filter to stop the resonance frequency.

In this embodiment, as illustrated in the sectional view in FIG. 3, the thin film multilayer electrode 28 in which an electrode layer 26 and a dielectric layer 27 are alternately laminated on two surfaces opposite to each other of the dielectric resonator 12*b*. Use of the thin film multilayer 28 can reduce the loss at the electrode part. Thus, the non loaded Q is increased compared with the case where a single-layered silver electrode, etc., is used. As a result, the height of the band elimination dielectric filter can be further reduced with the same non loaded Q compared with the band elimination dielectric filter 10 in the first embodiment.

Needless to say, similar effect can be obtained by using the thin film multilayer electrode in the two-stage band elimination dielectric filter of the first embodiment.

Figure 4:
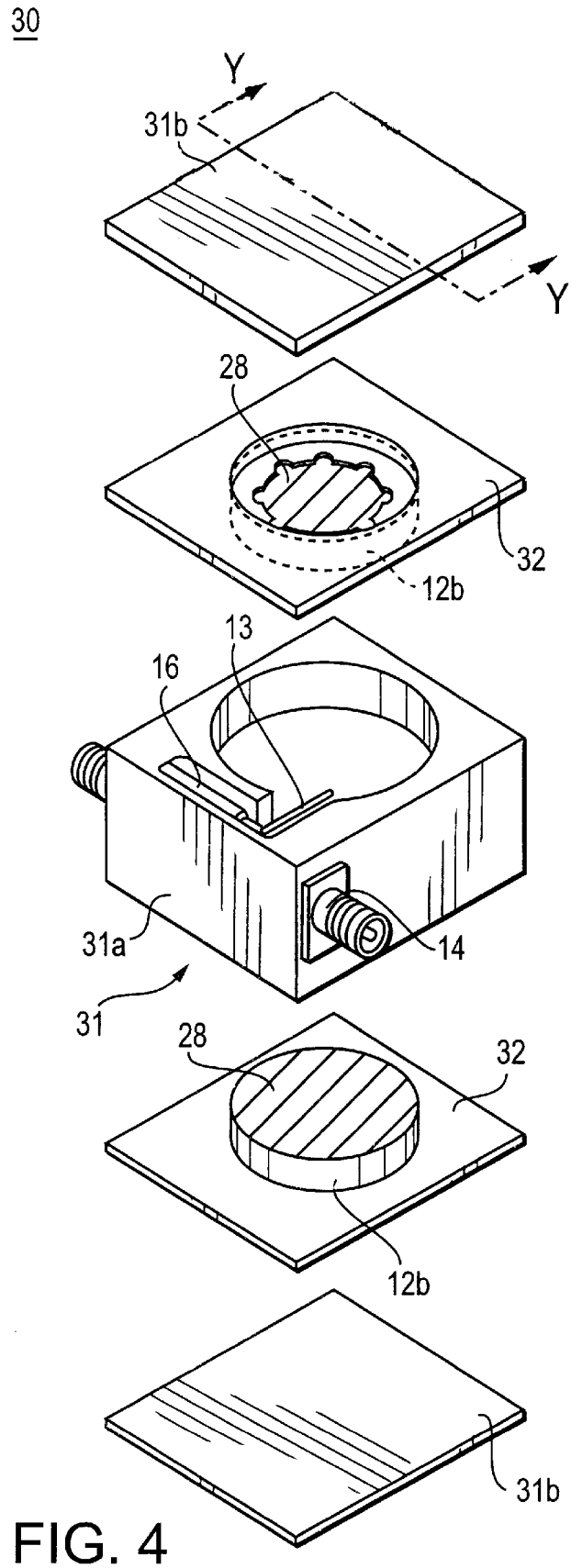
FIG. 4 is an exploded perspective view of a band elimination dielectric filter in a third embodiment of the present invention.
Figure 5:
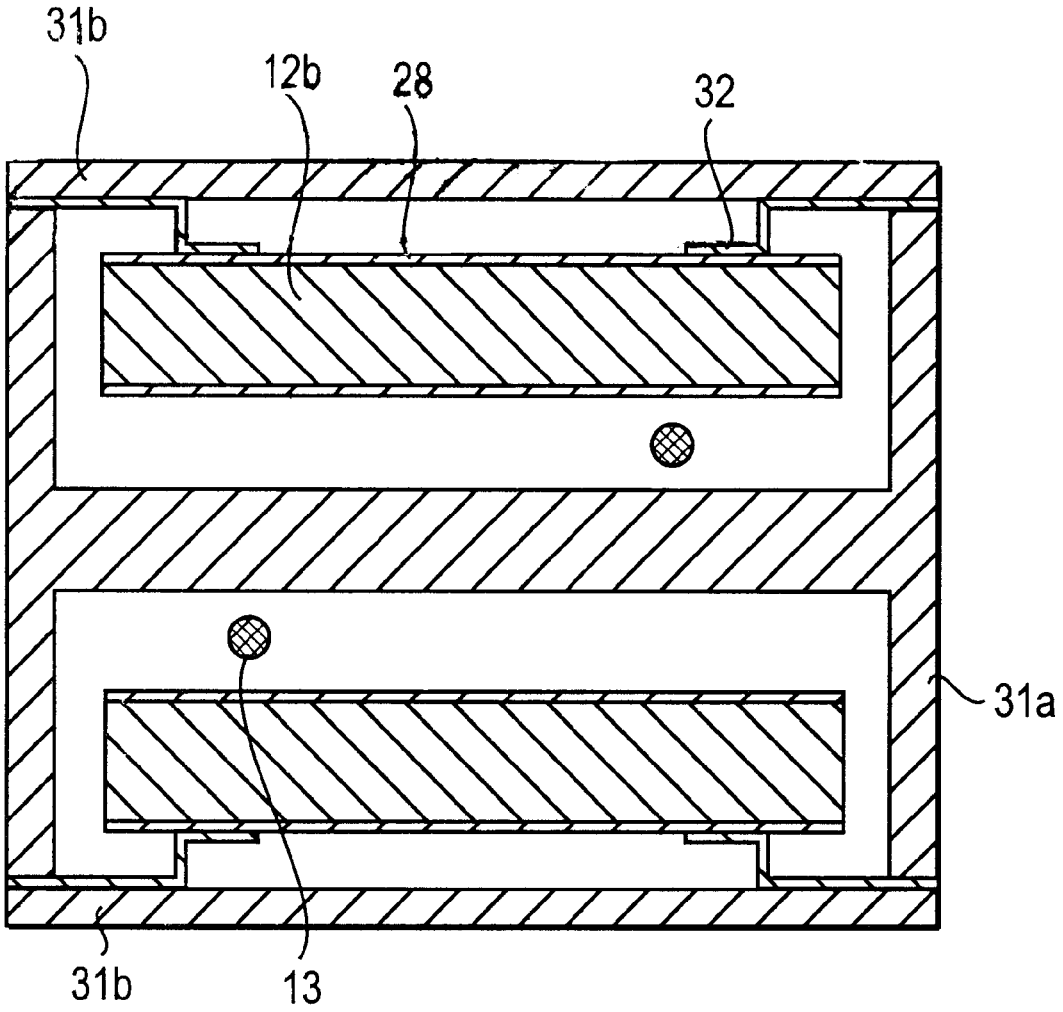
FIG. 5 is a sectional view taken along the line Y—Y of FIG. 4.

A band elimination dielectric filter of the third embodiment of the present invention is described referring to FIG. 4 and FIG. 5. FIG. 4 is an exploded perspective view of a band elimination dielectric filter of the present embodiment, and FIG. 5 is a sectional view taken along the line Y—Y in FIG. 4. The same symbol is attached to the same part in the first embodiment, and the detailed description is omitted.

As illustrated in FIGS. 4 and 5, a band elimination dielectric filter 30 of the present embodiment comprises a shield cavity 31 in which an iron part is silver-plated and recessed parts are formed on a face side and a back side, a columnar dielectric resonator 12*b* in which a thin film multilayer electrode 28 is formed on two surfaces opposite to each other, an earth plate 32 in which a copper plate is silver-plated, an external coupling means 13 comprising a metallic wire, and external connectors 14 mounted on the shield cavity 31.

An earth plate 32 having a stepped part and a hole for soldering is soldered on one surface on which the thin film multilayer electrode 28 of the dielectric resonator 12*b* is formed. Because the earth plate 32 is held by a body 31a of the shield cavity 31 and a lid part 31*b*, the dielectric resonator 12*b* is arranged in the recessed parts on the face side and the back side of the shield cavity 31.

One end of the external coupling means 13 is connected to a center conductor of the external connector 14 mounted on the shield cavity 31, and extended between the shield cavity 31 and the dielectric resonator 12*b*. Further, the center conductors of the external connectors 14 are connected to each other through a $\lambda/4$ wavelength line 16.

In such a band elimination dielectric filter 30, the signal to be inputted from the external connector 14 flows from the external connector 14 to the external coupling means 13, and generates the capacitance between the external coupling means 13 and the dielectric resonator 12*b*. The external coupling means 13 is coupled with the dielectric resonator 12*b* with the capacitance, and the external coupling means is resonated at the resonance frequency specified by the area of the dielectric resonator 12*b* at the section parallel to the thin film multilayer electrode 28, and functions as the two-stage band elimination dielectric filter to stop the frequency band.

In such a band elimination dielectric filter 30 where the dielectric resonators 12*b* are laminated, the actual current hardly flows in the shield cavity 31, and the loss generated by the actual current flowing in the conductive layer (equivalent to the shield cavity) on the surface of the cavity of the dielectric resonator in the conventional band elimination dielectric filter can be eliminated. Thus, the height of the band elimination dielectric filter can be reduced compared with the conventional band elimination dielectric filter though the characteristics are similar. Further, the area can be reduced compared with the first embodiment, the band elimination dielectric filter in which the dielectric resonators are continuously arranged as illustrated in the first embodiment and the band elimination dielectric filter in which the dielectric resonators are put on top of each other can be selectively used according to the intended use.

Figure 6:
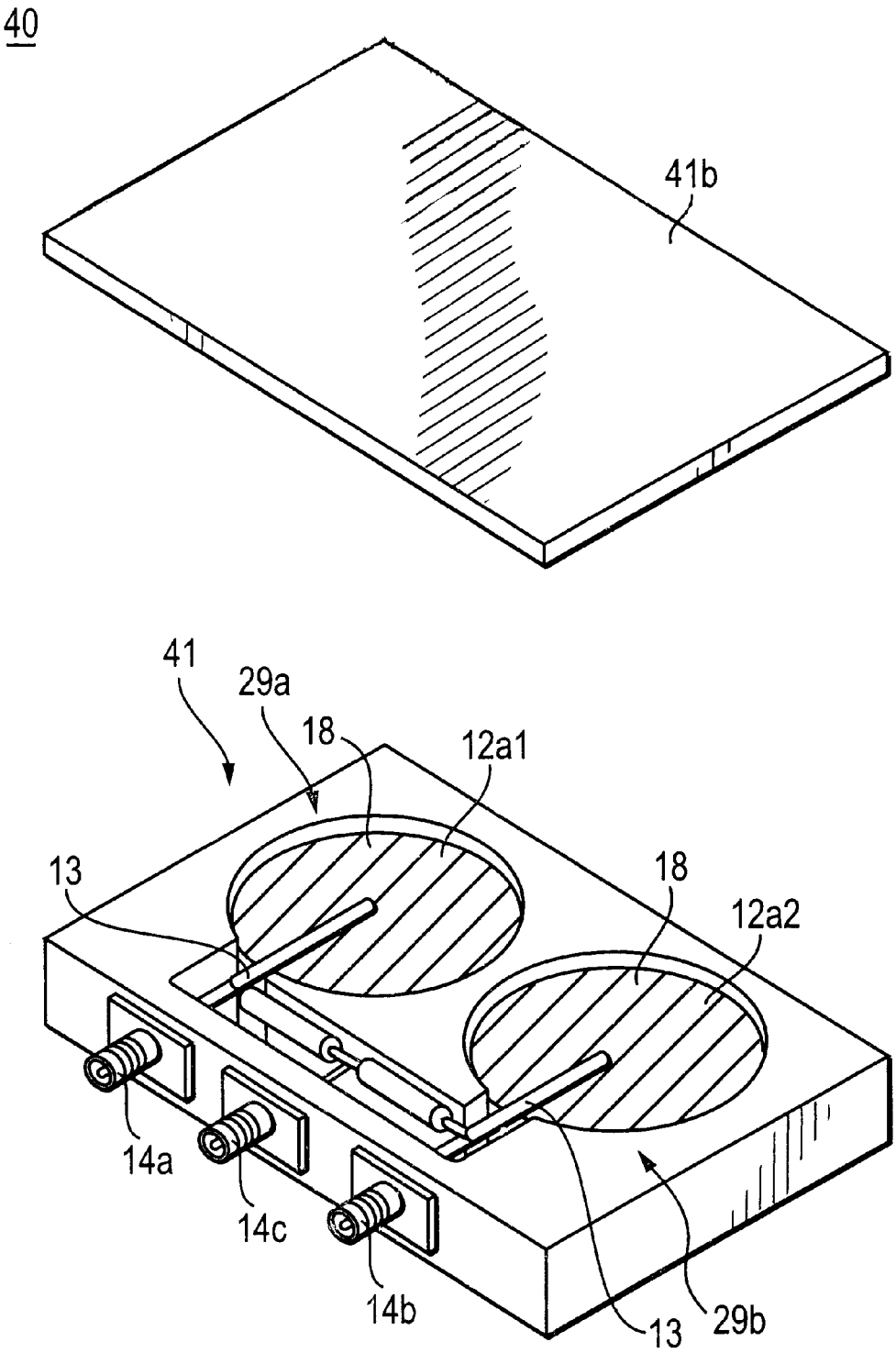
FIG. 6 is an exploded perspective view of a dielectric duplexer in a fourth embodiment of the present invention.

A fourth embodiment of the present invention is described referring to FIG. 6. FIG. 6 is an exploded perspective view in which a lid part 41*b* of a shield cavity 41 in a dielectric duplexer 40 is opened to illustrate the inner condition. The same symbol is attached to the same part of the above-mentioned embodiment, and the detailed description is omitted.

As illustrated in FIG. 6, the dielectric duplexer 40 of the present embodiment comprises a metallic shield cavity 41, two columnar dielectric resonators 12*a*1 , 12*a*2 provided with electrodes 18 formed on two surfaces opposite to each other and having different resonance frequencies, and an external coupling means 13. A dielectric filter part 29*a* for transmission comprises one dielectric resonator 12*a*1 , and a dielectric filter part 29*b* for reception comprises the other dielectric resonator 12*a*2. An external connector 14*a* for connecting a transmission circuit, an external connector 14*b* for connecting a reception circuit, and an external connector 14*c* for connecting an antenna are mounted on the shield cavity 41, the external connector 14*a* for connecting the transmission circuit is connected to the dielectric filter part 29*a* for transmission, while the external connector 14*b* for the reception circuit is connected to the dielectric filter part 29*b* for reception. The external connector 14*c* for connecting the antenna is connected to both the dielectric filter part 29*a* for transmission and the dielectric filter part 29*b* for reception.

This dielectric duplexer 40 is resonated at the resonance frequency specified by the area of the electrodes 18 of the dielectric resonator 12*a*1 of the dielectric filter part 29*a* for transmission at the section parallel to the electrodes 18, and the resonance frequency is stopped. Similarly, the dielectric duplexer is resonated at the resonance frequency specified by the area of the dielectric resonator 12*a*2 of the dielectric filter part 29*b* for a reception at the section parallel to the electrodes 18, and the resonance frequency is stopped. The dielectric duplexer functions to stop the respective bands in transmission and reception.

In the dielectric duplexer 40 of such a construction, the actual current hardly flows in the shield cavity 41, and the loss generated by the actual current flowing in the conductive layer (equivalent to the shield cavity) on the surface of the cavity of the dielectric resonator in the conventional dielectric duplexer can be eliminated. The height of the dielectric duplexer can be reduced compared with the conventional dielectric duplexer while keeping the similar characteristic.

In the present embodiment, the dielectric filter part 29*a* for transmission and the dielectric filter part 29*b* for reception are formed of each of dielectric resonators 12*a*1, 12*a*2, but a dielectric duplexer of a plurality of stages may be formed using a plurality of dielectric resonators. A thin film multilayer electrode may be used for the electrode.

Figure 7:
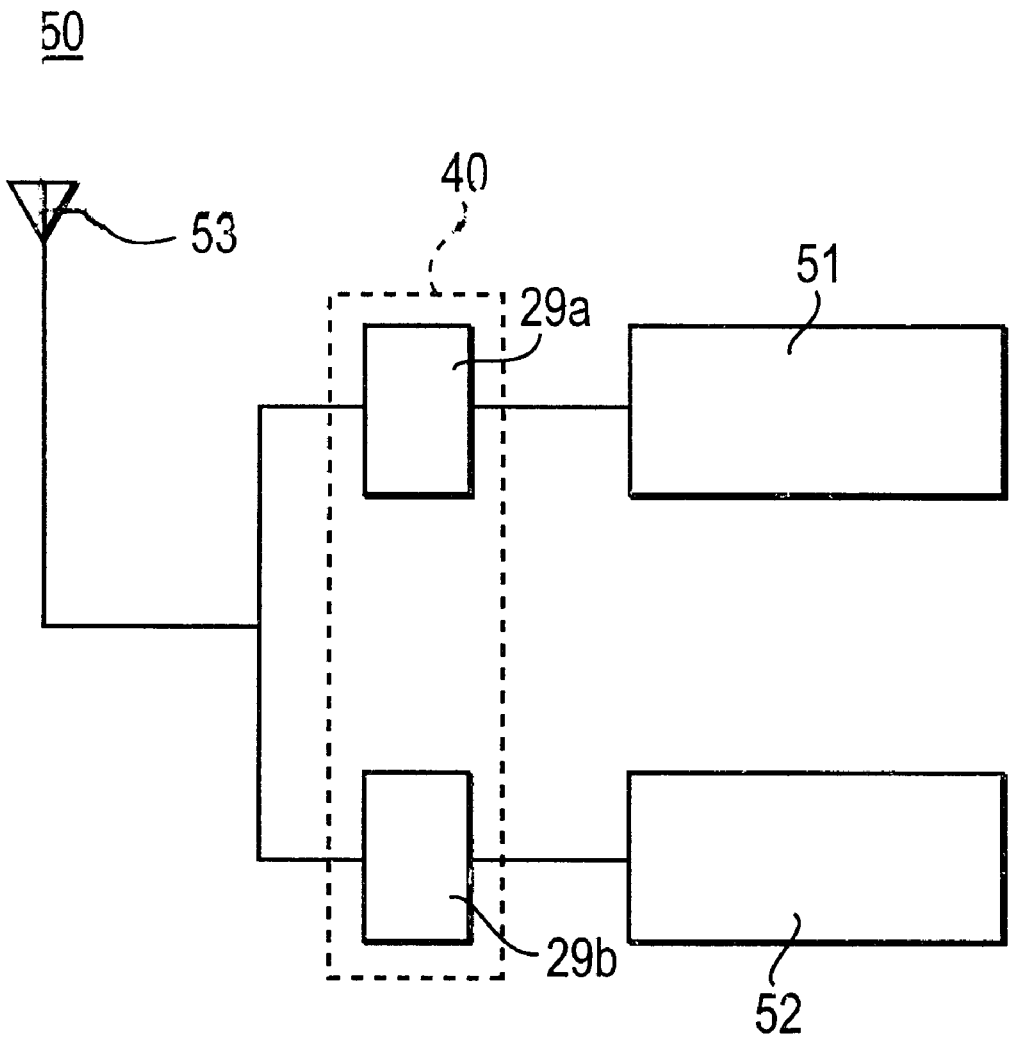
FIG. 7 is a schematic diagram of a communication device of the present invention.
Figure 8:
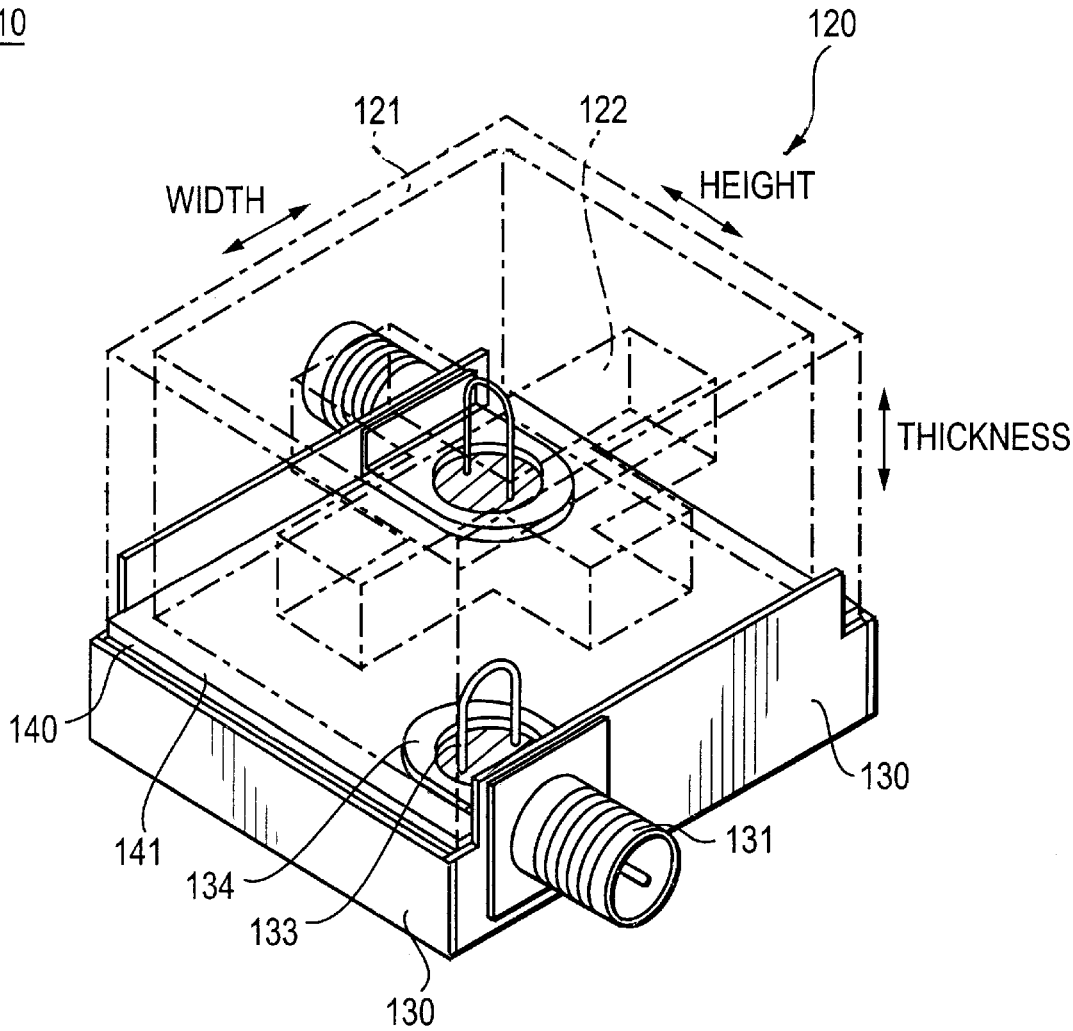
FIG. 8 PRIOR ART
FIG. 8 is a schematic perspective view of a conventional band elimination dielectric filter.
Figure 9:
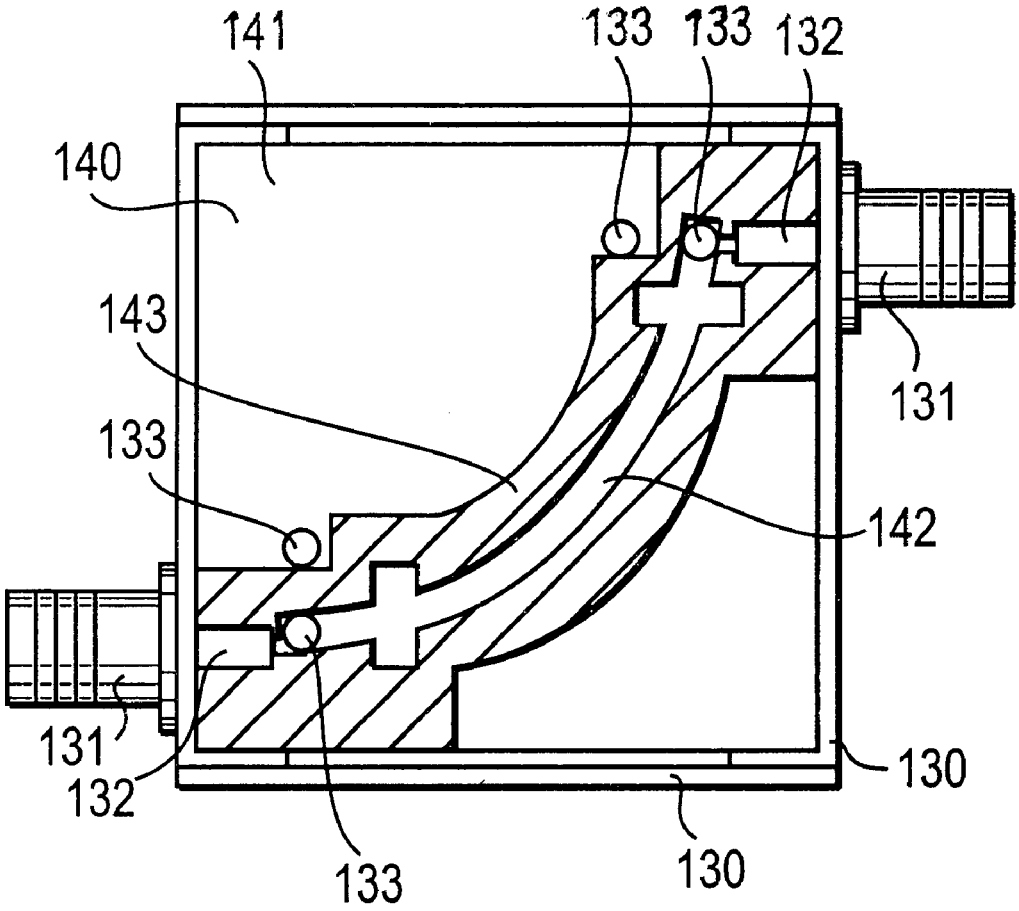
FIG. 9 PRIOR ART
FIG. 9 is a bottom plan view of a conventional band elimination dielectric filter.

Still further, a communication device which is a fifth embodiment of the present invention is described referring to FIG. 7. FIG. 7 is a schematic diagram of the communication device of the present embodiment.

As illustrated in FIG. 7, a communication device 50 of the present embodiment comprises a dielectric duplexer 40, a transmission circuit 51, a reception circuit 52, and an antenna 53. The dielectric duplexer 40 is same as that illustrated in the above-mentioned embodiment, an external connector 14*a* to be connected to the first dielectric filter part 29*a* in FIG. 6 is connected to the transmission circuit 51, and an external connector 14*b* to be connected to the second dielectric filter part 29*b* is connected to the reception circuit 52. An external connector 14*c* is connected to the antenna 53.

In such a construction, the communication device in which the non loaded Q can be improved if the shape is same, or the height or the area can be reduced if the non loaded Q is same, can be provided.

In the present invention, the actual current hardly flows in the shield cavity in which the dielectric resonator is stored. Thus, the loss generated in the conventional part is eliminated, and the non loaded Q is improved. As a result, the height of the band elimination dielectric filter, the dielectric duplexer and the communication device can be reduced compared with the conventional structure if the non loaded Q is same.

Further, in the two-stage band elimination dielectric filter and the dielectric duplexer of the present invention, the resonance frequency can be regulated by the area at the section parallel to the electrode of the dielectric resonator, and the non loaded Q can be regulated mainly by the height of the dielectric resonator, and both the resonance frequency and the non loaded Q can be individually regulated. As a result, the degree of freedom of the design in the shape of the dielectric resonator is increased, the labor of fine regulation during the manufacture is reduced, and the band elimination dielectric filter and the dielectric duplexer having the desired characteristic can be easily provided. In addition, fine regulation has been conventionally required so that dielectric columns crossing each other of the TM double mode dielectric resonator are not coupled, but in the two-stage band elimination dielectric filter of the present invention, two dielectric resonators are separated from each other, and can be individually regulated, and fine regulation becomes unnecessary.

Further, the loss at the electrodes can be reduced compared with a single-layered electrode by forming the electrodes formed on two surfaces opposite to each other of the dielectric resonator of a thin film multilayer electrode. Thus, the non loaded Q is improved, and the band elimination dielectric filter, the dielectric duplexer, and the communication device in which the height is further reduced if the non loaded Q is same, and the non loaded Q is further improved, can be manufactured.

What is claimed is:

1. A TM010 mode band elimination dielectric filter comprising:

a conductive shield cavity;

at least one TM010 mode dielectric resonator being arranged in said shield cavity;

electrodes formed on the opposite surfaces of said dielectric resonator; and an external coupling element being spaced away from said dielectric resonator while being coupled with said TM010 mode of said dielectric resonator;

wherein said at least one dielectric resonator comprises a plurality of said dielectric resonators which are disposed on top of each other in said shield cavity.

2. A band elimination dielectric filter according to claim 1, wherein said at least one dielectric resonator comprises a plurality of said dielectric resonators which are continuously arranged in said shield cavity.

3. A band elimination dielectric filter according to claim 1, wherein at least one of electrodes formed on two surfaces opposite to each other of said dielectric resonator is formed of a thin multilayer electrode.

4. A dielectric duplexer comprising:

at least two dielectric filters;

a respective input/output connection to be connected to each of said dielectric filters, and an antenna connection to be commonly connected to said dielectric filters, wherein, at least one of said dielectric filters is the band elimination dielectric filter according to claim 1.

5. A communication device comprising:

a dielectric duplexer according to claim 4, a circuit for transmission to be connected to at least one of said input/output connections of said dielectric duplexer;

a circuit for reception to be connected to at least the other one of said input/output connections of said dielectric duplexer.

6. A communication device according to claim 5, further comprising an antenna to be connected to said antenna connection of said dielectric duplexer.

* * * * *